US006758706B2

(12) United States Patent
Ogino

(10) Patent No.: US 6,758,706 B2
(45) Date of Patent: Jul. 6, 2004

(54) MARINE PROPULSION HOUSING ARRANGEMENT

(75) Inventor: Hiroshi Ogino, Shiznoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/060,907

(22) Filed: Jan. 29, 2002

(65) Prior Publication Data

US 2002/0127927 A1 Sep. 12, 2002

Related U.S. Application Data

(63) Continuation of application No. 09/404,237, filed on Sep. 23, 1999, now Pat. No. 6,341,991.

(30) Foreign Application Priority Data

Sep. 25, 1998 (JP) ..... 10-272185

(51) Int. Cl.[7] ..... B63H 20/32
(52) U.S. Cl. ..... 440/77; 440/76
(58) Field of Search ..... 440/52, 53, 76, 440/78

(56) References Cited

U.S. PATENT DOCUMENTS

| | | | | |
|---|---|---|---|---|
| 2,442,728 A | | 6/1948 | Kiekhaefer | |
| 2,860,594 A | | 11/1958 | Kiekhaefer | |
| 4,323,355 A | | 4/1982 | Kondo | |
| 4,507,090 A | | 3/1985 | Kobayashi et al. | |
| 5,407,372 A | * | 4/1995 | Mondek et al. | 440/52 |
| 5,501,621 A | * | 3/1996 | Shigedomi et al. | 440/52 |
| 5,613,470 A | * | 3/1997 | Shiomi et al. | |
| 5,799,925 A | | 9/1998 | Kumita et al. | |
| 5,846,106 A | | 12/1998 | Kumita | |
| 5,931,711 A | | 8/1999 | Nakamura | |
| 5,967,865 A | | 10/1999 | Nakamura et al. | |
| 6,341,991 B1 | * | 1/2002 | Ogino | 440/52 |

* cited by examiner

*Primary Examiner*—Ed Swinehart
(74) *Attorney, Agent, or Firm*—Knobbe, Martens, Olson & Bear, LLP.

(57) ABSTRACT

A marine propulsion housing arrangement includes an improved construction for inhibiting an influx of water into the housing and for protecting the components thereof. A marine outboard drive comprises a drive unit and at least a swivel bracket that supports the drive unit for pivotal movement with a steering shaft. At least one mount assembly is provided for unifying the drive unit and the steering shaft. The mount assembly includes at least one mount members affixed to the drive unit and a hub member united with the mount member. The hub member is connected to both the drive unit and the steering shaft so as to unify them. A mount cover generally covers both of the mount member and the hub member.

17 Claims, 8 Drawing Sheets

MARINE PROPULSION HOUSING ARRANGEMENT

PRIORITY INFORMATION

This application is a continuation application of U.S. patent application Ser. No. 09/404,237 filed Sep. 23, 1999, now U.S. Pat. No. 6,341,991, issued Jan. 29, 2002.

BACKGROUND OF THE INVENTION

1. Field of the Invention

This invention relates to a marine propulsion housing arrangement, and more particularly to an improved marine propulsion housing arrangement that can effectively prevent water from entering housing.

2. Description of Related Art

An outboard motor typically is mounted on a transom of an associated watercraft by means of a bracket assembly which comprises a swivel bracket and a clamping bracket. The drive unit generally includes a powering engine, a driveshaft, a propulsion device and a housing assembly. The housing assembly contains or supports the components therein. The drive unit as constructed is supported by the swivel bracket by means of mount assemblies.

FIGS. 1 and 2 illustrate an exemplary outboard motor with a conventional support structure that couples the swivel bracket to the drive unit. In particular, FIG. 1 illustrates an elevational side view of a conventional outboard motor 16 mounted on a transom 18 of an associated watercraft 20, and FIG. 2 illustrates a cross-sectional plan view taken along the line 2—2 in FIG. 1 and showing a lower mount assembly 22 and cover members 24.

A drive unit 26 of the outboard motor 16 comprises a power head 28, a driveshaft housing 30 and a lower unit 32. The power head 28 includes an engine 34 and a protective cowling 36 encircling the engine 34. The driveshaft housing 30 depends from the power head 28 and supports a driveshaft which is driven by an output shaft of the engine 34 and extends vertically. The lower unit 32 depends from the driveshaft housing 30 and supports a propeller shaft, which is driven by the driveshaft, and a propeller 38 driven by the propeller shaft. There is a transmission mechanism including a bevel gear between the driveshaft and the propeller shaft. This transmission mechanism is shifted with a shift rod 39 so as to change a rotational direction of the propeller 38 to forward, neutral or reverse.

A swivel bracket 42 supports the drive unit 26 for pivotal movement about a generally vertically extending axis, i.e., an axis of a steering shaft 44. The steering shaft 44 passes through a shaft housing 46 of the swivel bracket 42. A clamping bracket 48 supports the swivel bracket 42 for pivotal movement about a generally extending axis, i.e., an axis of a pivot shaft 50.

An upper mount assembly 54 and the lower mount assembly 22 are provided for connecting the driveshaft housing 30 and the steering shaft 44. A steering shaft 57 is affixed to the upper mount assembly 54 and extends forwardly so that the drive unit 26 is steerable by an operator of the outboard motor 16.

The lower mount assembly 22, as shown in FIG. 2, comprises a pair of mount members 58 and a hub member 60. The respective mount members 58 are formed with inner tubes 62, outer tubes 64 and elastic bushings 66. The elastic bushings 66 are formed between the inner and outer tubes 62, 64. The hub member 60 has a boss 68 with a vertically extending bore 70. The steering shaft 44 passes through the bore 70. At both sides of the boss 68, a couple of holes 72 are provided. These holes 72 extend horizontally and fore to aft.

A front portion of the driveshaft housing 30 has a pair of recesses 73, which axes extends horizontally and fore to aft. The mount members 58 are seated in these recesses 73. A pair of bolts 74 are inserted into the inner tubes 62 of the mount members 58 and the bores 72 of the hub member 182 and then nuts 76 are placed at the other sides of the bolt heads. By tightening the bolts 74 and the nuts 76, both of the members 58, 60 are united with each other.

The lower mount assembly 22 completes with a pair of outer holders 78 that have recesses 80. The recesses 80 of outer holders 78 are then fitted onto the outer tubes 64 and fastened to the driveshaft housing 30 with bolts (not shown). Thus, the lower mount assembly 22 is affixed to the driveshaft housing 30.

The steering shaft 44 is joined with both of the upper and lower mount assemblies 54, 22 by spline connections. Accordingly, the drive unit 26 is steerable within the shaft housing 46 of the swivel bracket 42.

The pair of cover members 24 are attached onto the outer holders 78 only for concealing outer appearance of the connections that involve the mount members 58, outer holders 78 and bolts 74. These cover members cover the hub member 60. In addition, the steering shaft 44 is tubular with open upper and lower ends to allow the shift rod 39 to passes therethrough. The associated watercraft 20 often changes its drive condition between forward and reverse. The outboard motor also is frequently trimmed up and down, and the watercraft often rises and falls as it speeds up or down or as the trim angle changes. Water surrounding the outboard motor 16 consequently can enter the steering shaft 44 from its bottom opening as shown by the arrow 82 in FIG. 1. The water, then, may go up through the steering shaft 44 and reach the power head 28. If this occurs, components such as an engine 34 within the power head 28 can be stained or salted by the water and then corrode or rust.

SUMMARY OF THE INVENTION

A need therefore exists for an improved marine propulsion housing arrangement that can inhibit water from entering a steering shaft.

In accordance with one aspect of the present invention, a marine outboard drive comprises a drive unit carrying a propulsion device. A steering shaft extends generally vertically. At least one mount assembly includes at least one mount member affixed to the drive unit and to a hub member that is united with the mount member. The hub member connects to both the drive unit and the steering shaft so as to unify the drive unit and the steering shaft. The outboard drive further comprises a swivel bracket that supports the steering shaft for pivotal movement about a steering axis. A mount cover is provided to generally cover both the mount member and the hub member.

In accordance with another aspect of the present invention, a marine outboard drive comprises a drive unit carrying a propulsion device. A tubular steering shaft has an open bottom end. At least one mount assembly is connected to both the drive unit and the steering shaft so as to couple together the drive unit and the steering shaft. The outboard drive further comprises a swivel bracket that supports the steering shaft for pivotal movement about a steering axis. A cover member covers generally encloses the bottom end of the steering shaft between the cover member and the drive unit.

Further aspects, features and advantages of this invention will become apparent from the detailed description of the preferred embodiment of the invention which follows.

BRIEF DESCRIPTION OF THE DRAWINGS

As noted above,

FIG. 2 shows a conventional lower mount assembly and cover members. These figures are provided in order to assist the reader's understanding of the conventional arrangements and for the reader to better appreciate the aspects, features and advantages associated with the present invention.

DETAILED DESCRIPTION OF THE PREFERRED EMBODIMENT OF THE INVENTION

Figure 1:
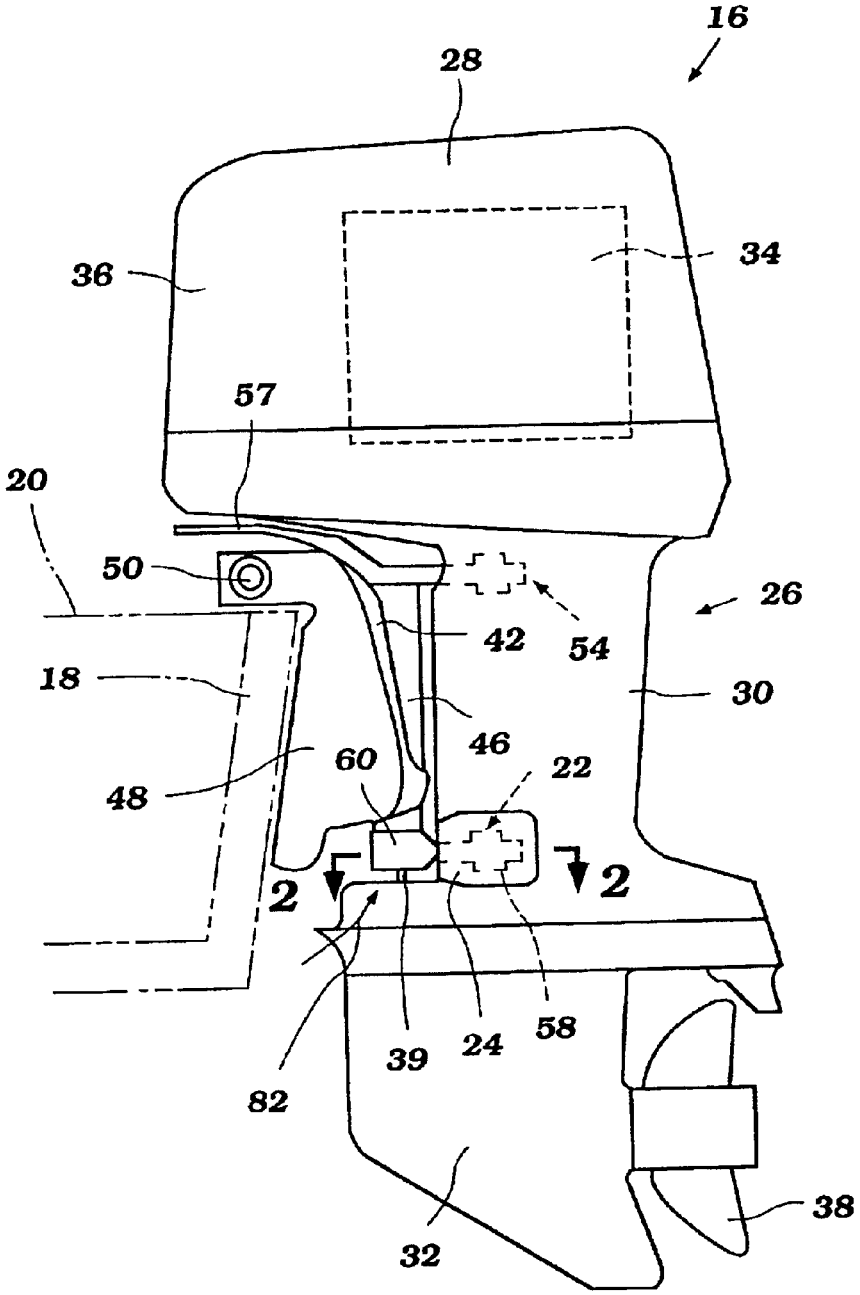
Figure 1 Prior Art
FIG. 1 illustrates an elevational side view of an exemplary conventional outboard motor and FIG. 2 illustrates a cross-sectional plan view taken along the line 2—2 in FIG. 1.
Figure 2:
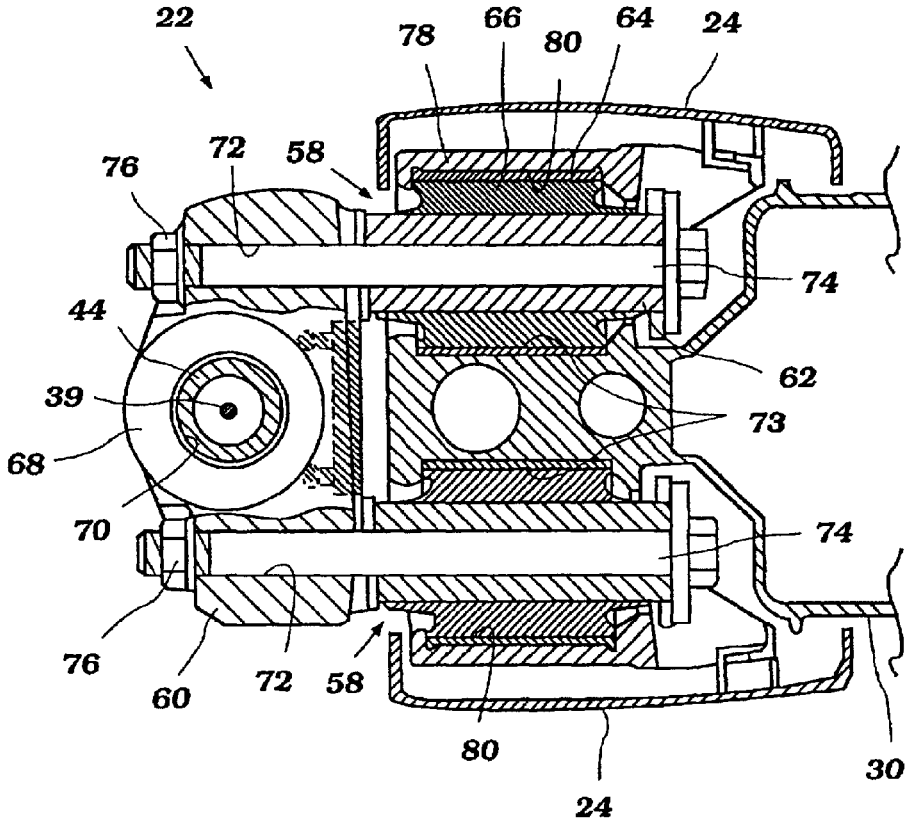
Figure 2 Prior Art
Figure 3:
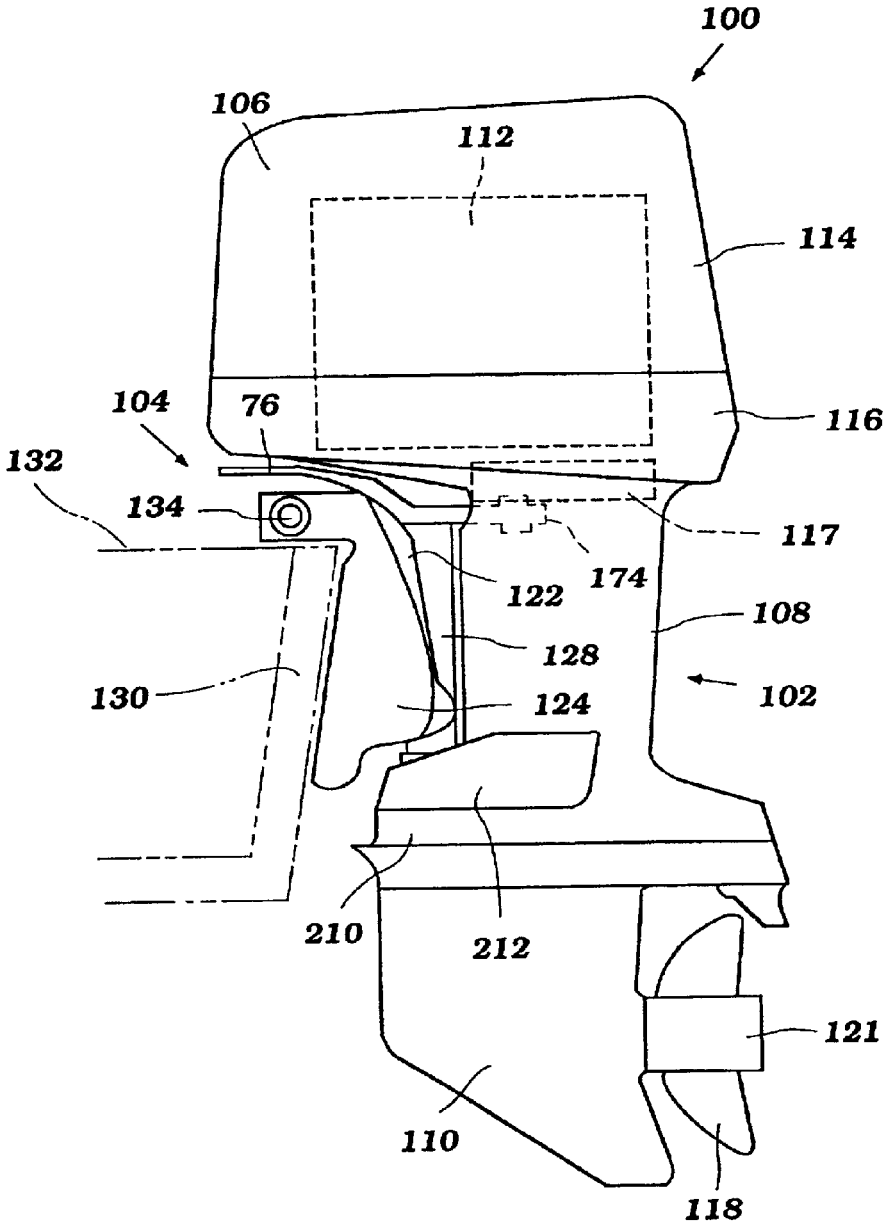
FIG. 3 is an elevational side view showing an outboard motor in accordance with an embodiment of this invention. An associated watercraft is sectioned and shown in phantom.
Figure 4:
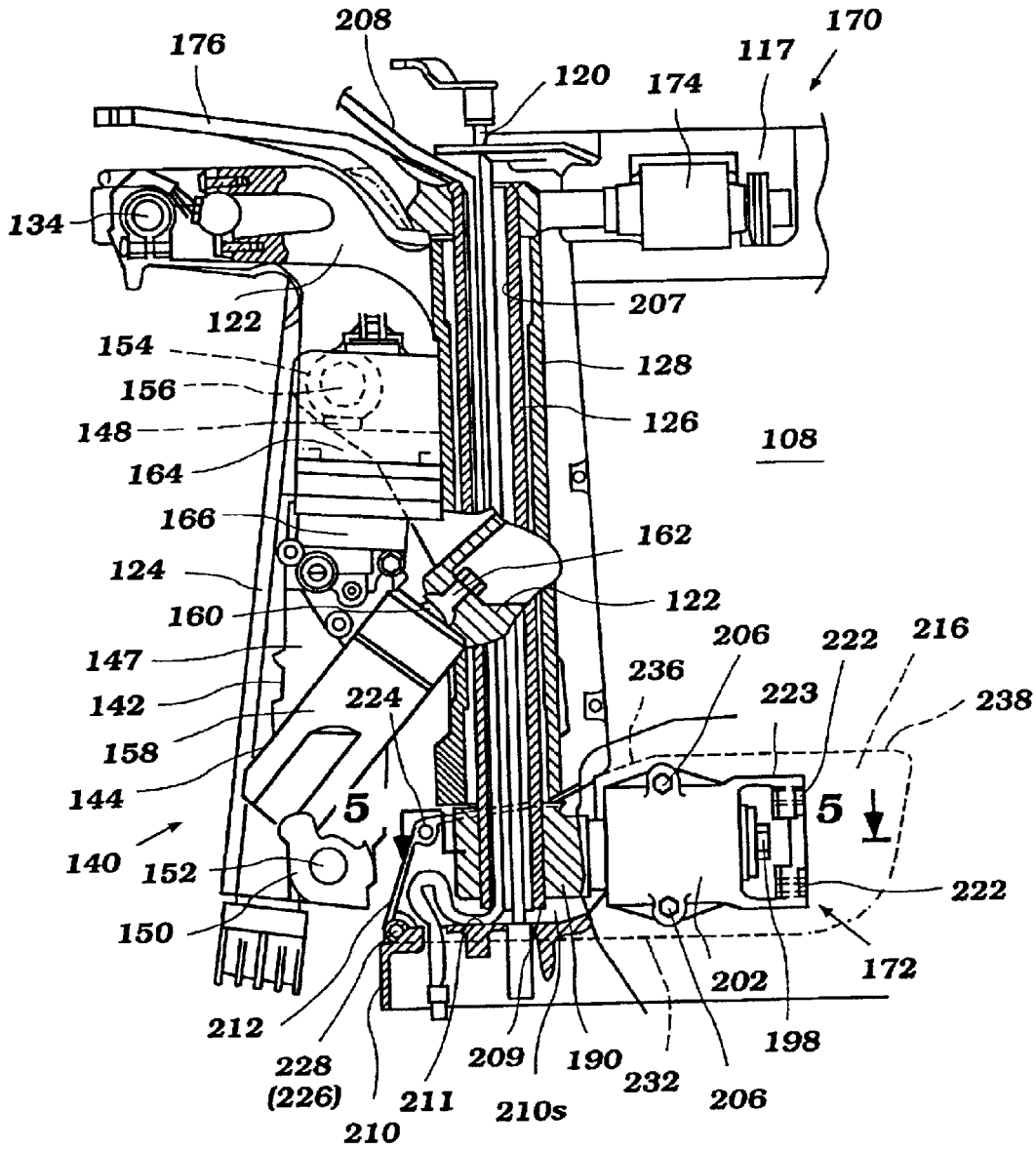
FIG. 4 is an enlarged cross-sectional, side elevational view taken along the line 44 of FIG. 5 and shows supporting structure of a drive unit of the outboard motor. A portions of a swivel bracket at which a piston rod of a trim adjustment fluid motor contacts is shown in a different cross-section. Also, a lower mount assembly disposed on the port side is partially shown. Further, a cover member positioned at the starboard side is partially seen.
Figure 5:
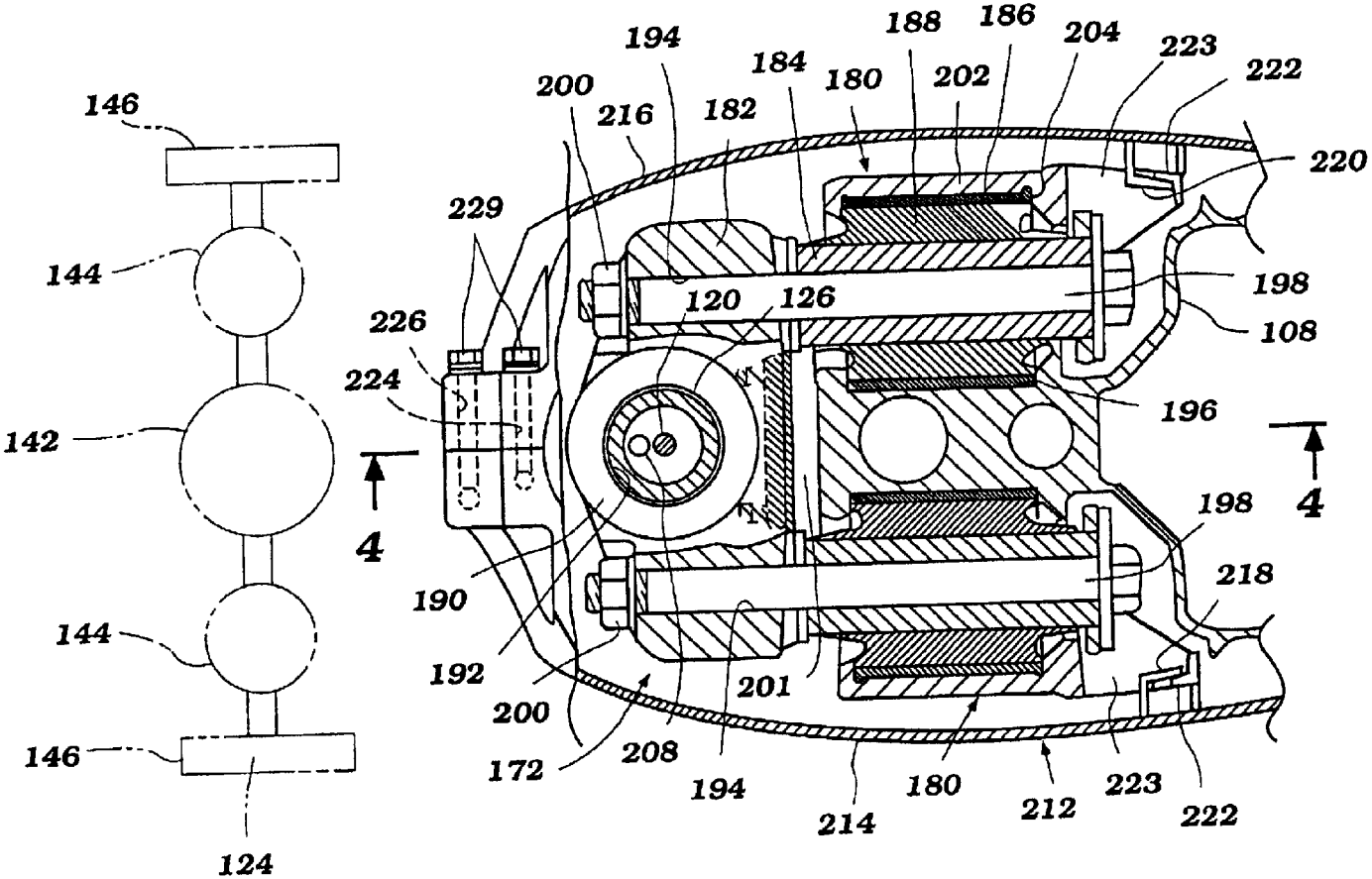
FIG. 5 is an enlarged cross-sectional plan view taken along the line 5—5 in FIG. 4 and shows the same supporting structure, particularly a lower mount assembly, and a mount cover. A hub member of the lower mount assembly and a forward portion of the mount cover are shown partially. Also, the principal positions of a tilt fluid motor and trim adjustment fluid motors are schematically shown in phantom.
Figure 6:
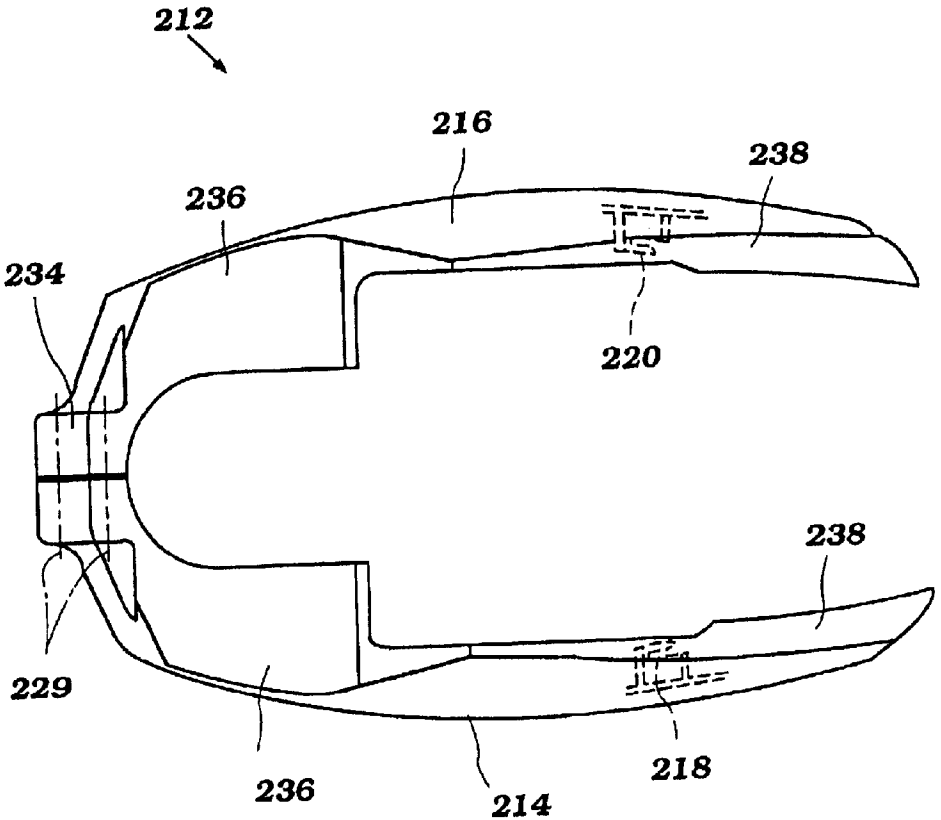
FIG. 6 is a top plan view showing the mount cover.

With reference to FIGS. 3 to 5, an outboard motor, designated generally by reference numeral 100, includes a housing arrangement configured in accordance with a preferred embodiment of the present invention. Although the present invention is shown in the context of an outboard motor, various aspects and features of the present invention also can be employed with other types of marine outboard drive units (e.g., a stem drive unit).

In the illustrated embodiment, the outboard motor 100 comprises a drive unit 102 and a bracket assembly 104. The drive unit 102 includes a power head 106, a driveshaft housing 108 and a lower unit 110. The power head 106 is disposed atop the drive unit 102 and includes an internal combustion engine 112, a top cowling 114 and a bottom cowling 116. The engine 112 powers a propulsion device of the outboard motor 100, which will be described shortly. In the illustrated form, the engine 112 has an output shaft extending generally vertically. The top and bottom cowlings 114, 116 generally completely enclose the engine 112.

The driveshaft housing 108 depends from the power head 106 and supports a driveshaft which is driven by the output shaft of the engine 112. The driveshaft extends generally vertically through the driveshaft housing 108. The driveshaft housing 108 also defines internal passages which form portions of an exhaust system through which exhaust gasses from the engine 112 are discharged. An exhaust guide 117, which also is a section of the exhaust system, is provided at the top of the driveshaft housing 108, as schematically shown in FIG. 3.

The lower unit 110 depends from the driveshaft housing 108 and supports a propeller shaft which is driven by the driveshaft. The propeller shaft extends generally horizontally through the lower unit 110. In the illustrated embodiment, the propulsion device includes a propeller 118 that is affixed to an outer end of the propeller shaft and is driven by the propeller shaft. A bevel gear transmission is provided between the driveshaft and the propeller shaft. The transmission couples together the two shafts which lie generally normal to each other (i.e., at a 90° shaft angle). The transmission has a mechanism to shift rotational directions of the propeller 118 to forward, neutral or reverse. The mechanism includes a shift rod 120 (see FIGS. 4 and 5) that will be described later.

The lower unit 110 also defines an internal passage that forms a discharge section of the exhaust system. At engine speeds above idle, the majority of the exhaust gasses are discharged to the body of water surrounding the outboard motor 100 through the internal passage and finally through a hub 121 of the propeller 118, as well known in the art.

The bracket assembly 104 comprises a swivel bracket 122 and a clamping bracket 124. The swivel bracket 122 supports the drive unit 102 for pivotal movement about a generally vertically extending axis, i.e., an axis of a steering shaft 126. The steering shaft 126 passes through a shaft housing 128 of the swivel bracket 122. The clamping bracket 124, in turn, is affixed to a transom 130 of an associated watercraft 132 and supports the swivel bracket 122 for pivotal movement about a generally horizontally extending axis, i.e., an axis of a pivot shaft 134.

As used through this description and claims, the terms "fore," "forward," "front," or "forwardly" mean at or to the side where the swivel bracket 122 is located and the terms "aft," "rear," "reverse," or "back" mean at or to the opposite side of the front side, unless indicated otherwise.

As best seen in FIG. 4, a tilt and trim hydraulic system 140 is provided between the swivel bracket 122 and the clamping bracket 124. The hydraulic system 140 includes a tilting fluid motor 142 and a pair of trim adjustment fluid motors 144. These fluid motors 142, 144 are disposed as schematically shown in FIG. 5 in phantom. That is, the fluid motors 142, 144 are generally positioned between two spaced apart members 146 of the clamping bracket 124. The tilting motor 142 is located at the center position and trim adjustment motors 144 are placed at both sides of the tilting motor 142. The illustrated embodiment of the tilt and trim adjustment system 140 is an exemplary form which such a system can take, and other systems can also be used with the present invention. In addition, in some applications, the present housing arrangement can be used in an outboard drive that does not employ a hydraulic tilt and trim system or that simply employs a hydraulic tilt and trim assist system for manual trim adjustments and tilt-up.

In the illustrated embodiment, as best seen in FIGS. 4 and 5, the tilting motor 142 includes a tilt cylinder member 147, a piston slidably supported in the tilt cylinder member 147 and a piston rod extending from the piston and outwardly from the cylinder member 147. The tilt cylinder member 147 is affixed to the clamping bracket 124 with a trunnion 150 for pivotal movement about a generally horizontally extending axis, i.e., an axis of a pivot shaft 152. The piston rod 148, in turn, is affixed to the swivel bracket 122 with a trunnion 154 for pivotal movement about a generally horizontally extending axis, i.e., an axis of another pivot shaft 156. The tilting fluid motor 142, thus, tilts up and down the swivel bracket 122 and the drive unit 102 when the piston in the tilt cylinder member 147 reciprocally moves therein.

The trim adjustment motors 144 include trim cylinder members 158, pistons slidably supported in the trim cylinder members 158 and piston rods 160 extending from the pistons and outwardly from the cylinder members 158. The trim cylinder members 158 are unified with the cylinder member 147 of the tilting motor 142 and hence affixed to the clamping bracket 142 commonly with the tilt cylinder member 147. Meanwhile, the piston rods 160 contact thrust taking members 162 affixed to the swivel bracket 122. The trim adjustment motors 144, thus, trim up and down the swivel bracket 122 and the drive unit 102 when the pistons in the trim cylinder members 158 reciprocally move therein.

The trim adjustment motors 144 moves the drive unit 102 within a trim adjustment range and the tilting motor 142 moves the unit 102 within a tilt range which continues from the trim range and higher than this range to a fully tilted up position.

The tilt and trim hydraulic system 140 further includes a reversible electric motor 164, a reversible hydraulic pump 166 and valving passages for pressurizing the pistons in both of the tilting motor 142 and the trim adjustment motors 144. The pistons reciprocally move in the respective cylinder members 147, 158 under the pressurize produced by the pump within the system.

As seen in FIGS. 3 to 5, a structure for supporting the drive unit 102, specifically the driveshaft housing 108 to the swivel bracket 122, will now be described. An upper mount assembly 170 and a lower mount assembly 172 are provided for supporting the driveshaft housing 108. That is, the upper and lower mount assemblies 170, 172 connect together the driveshaft housing 108 and the steering shaft 126. Because the steering shaft 126 is received in the shaft housing 128, as noted above, the driveshaft housing 108 is pivotally supported by the swivel bracket 122.

The upper mount assembly 170 has a pair of mount members 174 that are affixed to the exhaust guide 117 on both sides of the driveshaft housing 108 in a suitable manner. A steering arm 176 is uniformly provided with the upper mount assembly 170 and extends forwardly so that the drive unit 102 is steerable by an operator (either manually or remotely) of the outboard motor 100. The upper mount assembly 170 is joined with the steering shaft 126 by a spline connection. Thus, the upper mount assembly 170 is detachable axially relative to the steering shaft 126, but pivots with the steering shaft 126 relative to the shaft housing 128. Since the upper mount assembly 170 is conventional and hence well known in the art, a further description is not believed to be necessary to permit those skilled in the art to practice the invention.

The lower mount assembly 172, as best seen in FIG. 5, comprises a pair of mount members 180 and a hub member 182. The respective mount members 180 include inner tubes 184, outer tubes 186 and elastic bushings 188. The elastic bushings 188 are internally disposed between the inner and outer tubes 184, 186 and baked with them. Thus, each mount member 180 functions as an integral unit.

The hub member 182 has a boss 190 where a vertically extending bore 192 is formed. The steering shaft 126 passes through the bore 192. On both sides of the boss 190, a pair of through holes 194 is provided. These holes 194 generally extend horizontally and fore to aft in the illustrated embodiment.

A front portion of the driveshaft housing 108 has a pair of recesses 196, which axes also extend horizontally and fore to aft in the illustrated embodiment. The mount members 180 are seated within these recesses 196. A pair of bolts 198 are inserted into the inner tubes 184 of the mount members 180 and the through holes 194 of the hub member 182 and then nuts 200 are attached to the front ends of the bolts with the bolt heads (and washers) disposed on the aft side of the mount members 180. By tightening the bolts 198 and the nuts 200, the members 180, 190 are united with each other. Of course other types of fasteners can also be used to connect the hub member 182 to the mount members 180.

As seen in FIG. 5, this construction provides a space 201 formed between a front portion of the driveshaft housing 108 and a back portion of the hub member 182.

The lower mount assembly 172 completes with a pair of outer holders 202 that have recesses 204. The recesses 204 of the outer holders 78 are, then, fitted onto the outer tubes 186 and fixed to the driveshaft housing 108 with bolts 206 (see FIG. 4). Thus, the lower mount assembly 172 is affixed to the driveshaft housing 108.

Like the upper mount assembly 170, the lower mount assembly 172 is joined with the steering shaft 126 by a spline connection. Thus, the lower mount assembly 172 is detachable axially relative to the steering shaft 126 but can rotate with the steering shaft 126.

As best seen in FIG. 4, the steering shaft 126 is tubular and has a bore 207 therethrough. The shift rod 120 extends from the power head 106 to the lower unit 110 and passes through the bore 207 of the steering shaft 126. The shift rod 120 is provided for shifting the transmission so as to change the rotational direction of the propeller 118 to forward, neutral or reverse. A speedometer cable 208 also passes through the bore 207 of the steering shaft 126. That is, rotational speed of the propeller 118 is sensed by a speed sensor disposed in proximity to the propeller shaft and then transmitted to a display device on a control panel of the associated watercraft 132 or on the top cowling 114 of the outboard motor 100 to indicate a current speed.

Because the shift rod 120 and the speedometer cable 208 extend from the steering shaft 126 to the lower unit 110, the bottom end 209 of the steering shaft 126 is unclosed and a front portion 210 of the driveshaft housing 108 extends forwardly below the steering shaft 126. Also, a space 210*s* is created between the bottom end 209 of the steering shaft 126 and a top surface 211 of the front portion 210 of the driveshaft housing 108 to provide clearance between these components.

An improved mount cover 212 is provided for covering the space 210*s*, as well as the lower mount assembly 172. The cover 212 inhibits an influx of water through the space 210*s* and the bore 207 and into the power head 106 when the water splashes upwardly, such as when the outboard motor 100 and the associated watercraft are quickly decelerated.

With reference now to FIGS. 3 through 8, the mount cover 212 is formed with a pair of cover members 214, 216, which in a preferred mode are made of synthetic resin; however, the covers 214, 216 can be made of other suitable material as well (e.g., plastic or corrosion-resistant metal). The cover members 214, 216 preferably have generally symmetrical shapes relative to each other. The cover member 214 is positioned on the port side, while the cover member 216 is positioned on the starboard side.

Figure 7:
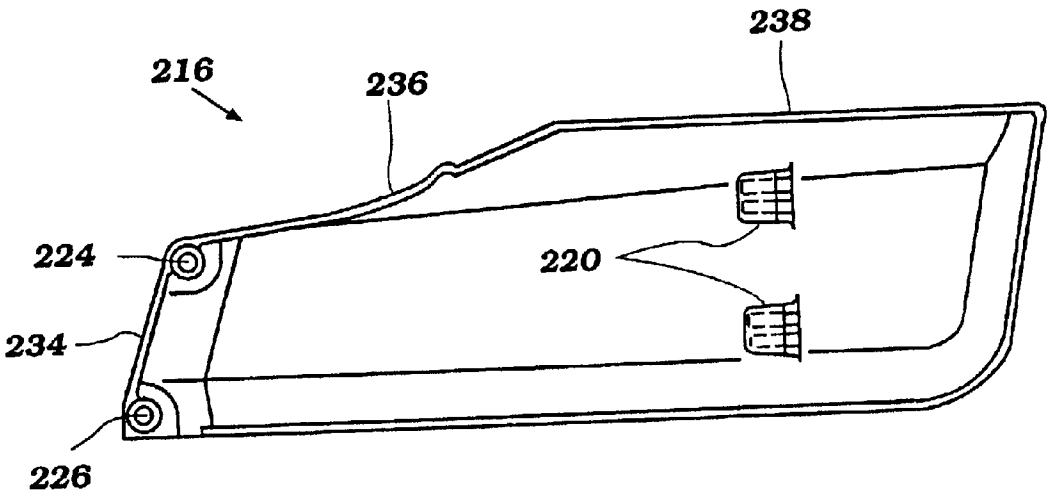
FIG. 7 is a side elevational view showing the inner face of a starboard side cover member of the mount cover illustrated in FIG. 6.
Figure 8:
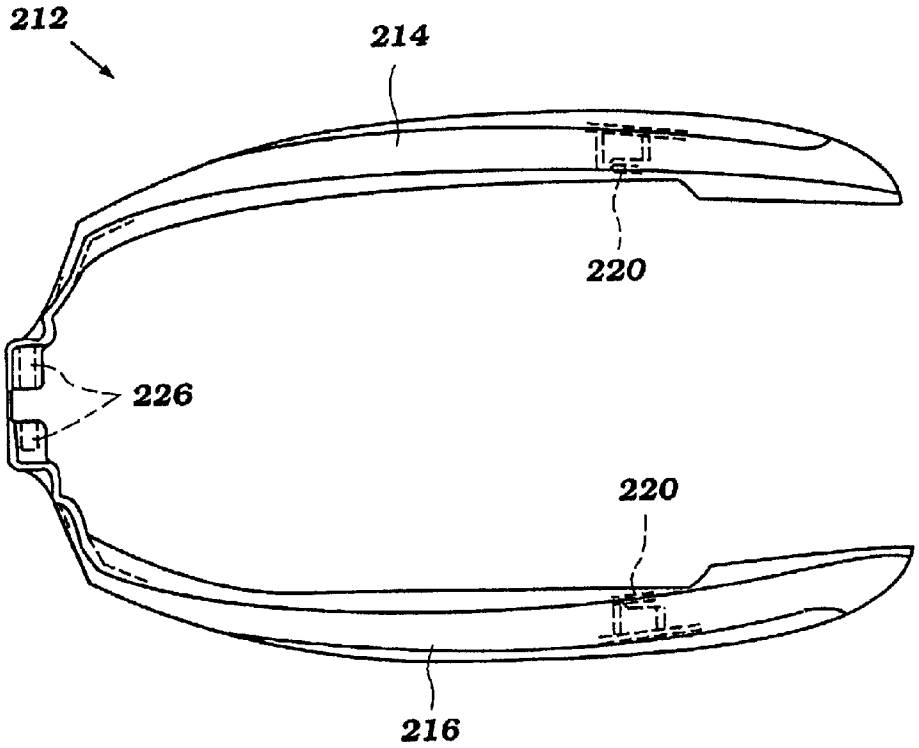
FIG. 8 is a bottom plan view showing the mount cover of FIG. 6.

As seen in FIG. 7, the respective cover members 214, 216 have a pair of engagement sections 218, 220 at their side portions, which are spaced apart vertically relative to each other. The respective outer holders 202, in turn, have a pair of engagement sections 222 at stays 223. The engagement sections 222 are also spaced apart vertically relative to each other. The cover members 214, 216 are, therefore, affixed to both of the outer holders 202 by engaging the sections 218, 220 of the cover members 214, 216 to the sections 222 with snap actions; i.e., the sections 218, 220 of the cover members 214, 216 snap onto the outer holders 202.

Both of the cover members 214, 216 are mated with each other at the respective front ends. Each cover member 214, 216, as best seen in FIG. 7, has an upper bolt hole 224 and a lower bolt hole 226, which are spaced generally vertically relative to each other. The front portion 210 of the driveshaft housing 108 also has a bolt hole 228. A pair of bolts 229 are, then, inserted into the bolt holes 224, 226, 228 and tightened to connect together the cover members 214, 216 and to connect the front portion 210 of the driveshaft housing 108. When affixed as described above, lower ends 232 of the cover members 214, 216 are positioned lower than the top surface 211 of the driveshaft housing 108 so that the space 210*s* is generally closed.

As best seen in FIG. 7, each front portion 234 of the cover members 214, 216, which exists between the bolt holes 224, 226, becomes abruptly lower toward the front end, while each middle portion 236, which exists between the bolt hole 224 and a rear portion, becomes moderately lower toward the front portion 234. The rear portion 238, in turn, has no slope thereon. Because of the sloped portions 234, 236, the mount cover 212 will not interfere with the swivel bracket 212 and the clamping bracket 124. In addition, in some rare instances, the elastic bushing 188 can be elastically deformed or contracted, by relatively large thrust force by the propeller 118. Under this condition, the driveshaft housing 108 and also the mount cover 212 advance forward. However, because of the sloped configuration of the mount cover 212, the mount cover 212 does not interfere with or contact the tilt and trim hydraulic system 140.

As seen in FIG. 4, the steering shaft 126 extends at the middle portions 236 of the cover members 214, 216 in the side elevational view. The middle portions 236 are positioned higher than the bottom end 209 of the steering shaft 126. Also, the rear portions 238 are positioned higher than the lower mount assembly 172. Thus, the mount cover 212 circumferentially covers the bottom end 209 of the steering shaft 126 and the lower mount assembly 172.

When the associated watercraft 132 moves forwards or in reverse by rotation of the propeller 118, water may be splashed over the drive unit 102. However, since the bottom end 209 of the steering shaft 126 is covered as described above, the splashed water is effectively inhibited from entering the bore 207 of the steering shaft 126. Accordingly, nothing in the power head 106 will be damaged by such splashed water.

Also, the mount cover 212 is affixed to the driveshaft housing 108 directly at its front end portion and indirectly via the outer holders 202 at both sides. Thus, the mount cover 212 is sufficiently rigid. The mount cover 212 is still detachable to be replaced easily with new one if broken. Also, the mount cover 212 can protect enough the components of the lower mount assembly 172 and keep good appearance of the outboard motor 100 likewise the conventional cover members.

Various configurations of the mount cover 212 are applicable inasmuch as it covers both of the mount members 180 and hub member 182 of the mount assembly 172. In addition, the mount cover 212 can be formed with any number of pieces and also can be made of any material such as metal including aluminum alloy if a replaced material has rigidity equal to or larger than the synthetic resin.

Also, various fastening constructions for the mount cover 212 are applicable. For instance, the engagement by the members 218, 220, 222 can be replaced by bolt connection. The lower ends 232 of the cover members 214, 216 can be positioned higher than the top end 211 of the driveshaft housing 108.

Further, the features of the present invention is practicable in the outboard drive section of an inboard/outboard drive.

Of course, the foregoing description is that of preferred embodiments of the invention, and various changes and modifications may be made without departing from the spirit and scope of the invention, as defined by the appended claims.

What is claimed is:

1. A marine outboard drive comprising a housing having an outer surface on an exterior of the outboard drive and at least one recessed area lying next to and being recessed relative to a portion of the outer surface, a steering shaft pivotal about a steering axis, at least one mounting mechanism being disposed in the recessed area and being coupled to the steering shaft and to the housing, and a pair of cover members configured to lie generally flush with at least the portion of the outer surface of the housing, each one of the cover members having a front portion with a front surface slanting forwardly and downwardly, the cover members being affixed to each other at lowermost sections of the respective front.

2. The marine outboard drive as set forth in claim 1, wherein the recessed area includes a pair of recessed portions that are disposed on opposite sides of the housing, the mounting mechanism includes a pair of mounting assemblies, each mounting assembly is disposed within one of the recessed portions, and each cover member is configured to cover the mounting assembly disposed within the respective recessed portion.

3. The marine outboard drive as set forth in claim 1, wherein the front surfaces of the cover members meet with each other in front of the steering shaft.

4. The marine outboard drive as set forth in claim 3 additionally comprising an elongated member, the housing including a lower portion, the steering shaft being tubular, the elongated member extending through the steering shaft and beyond a bottom end thereof into a lower portion of the housing, the front portions of the cover members defining a space in front of the steering shaft, at least a portion of the elongated member extending through the space.

5. The marine outboard drive as set forth in claim 4, wherein the lower portion of the housing includes a horizontal section extending generally horizontally and below the steering shaft, the horizontal section defines a first aperture under the steering shaft and a second aperture forwardly of the first aperture, and the elongated member extends through the second aperture.

6. The marine outboard drive as set forth in claim 4, wherein the elongated member is a cable.

7. The marine outboard drive as set forth in claim 6, wherein the cable includes at least one electrically conductive wire.

8. The marine outboard drive as set forth in claim 6, wherein the cable is a speedometer cable.

9. A marine outboard drive comprising a housing having an outer surface on an exterior f the outboard drive and at least one recessed area lying next to a portion of the outer surface and being recessed relative to the portion of the outer surface, a tubular steering shaft pivotal about a steering axis, at least one mounting mechanism disposed in the recessed area and coupled to the steering shaft and to the housing, an elongated member extending through the steering shaft and beyond a bottom end thereof into a lower portion of the housing, and cover members configured to lie generally flush with at least the portion of the outer surface of the housing, each one of the cover members having a front portion coupled with each other to define a space in front of the steering shaft, at least a portion of the elongated member extending through the space.

10. The marine outboard drive as set forth in claim 9, wherein the lower portion of the housing includes a horizontal section extending generally horizontally and below the steering shaft, the horizontal section defines a first aperture under the steering shaft and a second aperture forwardly of the first aperture, the elongated member extends through the second aperture.

11. The marine outboard drive as set forth in claim 9, wherein the elongated member is a cable.

12. The marine outboard drive as set forth in claim 11, wherein the cable includes at least one electrically conductive wire.

13. The marine outboard drive as set forth in claim 11, wherein the cable is a speedometer cable.

14. The marine outboard drive as set forth in claim 9, wherein the elongated member is flexible.

15. The marine outboard drive as set forth in claim 9, wherein the elongated member warps in the space.

16. The marine outboard drive as set forth in claim 9 additionally comprising a second elongated member extending through the steering shaft, wherein the second elongated member does not extend through the space.

17. The marine outboard drive as set forth in claim 10, wherein the tubular steering shaft defines a bottom surface, the elongated member extends below at least a portion of the bottom surface.

* * * * *